US006244233B1

(12) United States Patent
Tryon et al.

(10) Patent No.: US 6,244,233 B1
(45) Date of Patent: Jun. 12, 2001

(54) PULL DOWN ENGINE STARTER

(76) Inventors: Lewis H. Tryon; David Scott Tryon, both of 2814 N. 17-92, Orange City, FL (US) 32763

( * ) Notice: Subject to any disclaimer, the term of this patent is extended or adjusted under 35 U.S.C. 154(b) by 0 days.

(21) Appl. No.: 09/432,537

(22) Filed: Nov. 3, 1999

Related U.S. Application Data

(60) Provisional application No. 60/107,216, filed on Nov. 5, 1998.

(51) Int. Cl.[7] ..... F02N 3/02

(52) U.S. Cl. ..... 123/185.3; 74/140

(58) Field of Search ..... 123/185.2, 185.3, 123/185.4; 74/140

(56) References Cited

U.S. PATENT DOCUMENTS

| | | | | |
|---|---|---|---|---|
| 1,156,718 | * | 10/1915 | Stabler | 123/185.3 |
| 2,293,322 | * | 8/1942 | Veach | 123/185.3 |
| 5,253,540 | * | 10/1993 | Sanders et al. | 123/185.4 |
| 5,762,037 | * | 6/1998 | Rothrock | 123/185.4 |

FOREIGN PATENT DOCUMENTS

3130044 A1 * 2/1983 (DE) .

* cited by examiner

*Primary Examiner*—Andrew M. Dolinar
(74) *Attorney, Agent, or Firm*—Edward M. Livingston, Esq.

(57) ABSTRACT

A pull-down engine starter has a pull-down line (1) that is attachable to a takeoff line (15) or directly to a rewind-starter wheel (14) and pulley-routed to a suspension pulley wheel (6, 25) from which a handle end of the pull-down line is suspended to conveniently grasping proximity to a user position such as a driver seat (8). For go-carts (4) and other rider-operated vehicles (12) with engines (3) having rewind starters (2), the user position is a driver's seat or a machine-operator position on the vehicles. For walk-behind machines (23) and other non-ride machines such as a generator set (24) with rewind-starter engines, the user position is generally lateral to the engine. Singular-suspension pulley wheels (25) are provided for singular-wheel pull-start lines (22) on head-high pull-down anchors (26) and waist-high pull-down anchors (27). Handle ends of singular-wheel pull-down lines suspended from singular-suspension pulley wheels on the head-high pull-down anchors have handles (28) and those on waist-high pull-down anchors have stirrups (29) that preferably are in stirrup guides (30).

5 Claims, 3 Drawing Sheets

10
17
1
14
21
2

1
16
15
14
2
21

22
27
25
29
30
2
3
13
23

27
25
22
24
29
30
2
3

25
26
28
22
24
2
3

PULL DOWN ENGINE STARTER

CROSS-REFERENCE TO RELATED APPLICATIONS

This application claims the benefit of U.S. Provisional Application No. 60/107,216, filed Nov. 5, 1998.

BACKGROUND OF THE INVENTION

This invention relates to pulling pull-start ropes down vertically instead of horizontally or obliquely for starting small engines having rewind or pull-line starters.

Pulling a rewind-starter pull rope horizontally, obliquely or laterally for starting a small engine is problematic, difficult and undesirable for various reasons that relate specifically to different vehicles and machines that use small engines with pull-rope starters in order to avoid weight and cost of electrical starters and electrical systems.

For recreational go-carts, pull-starting is particularly troublesome and quite dangerous. One person must be in the driver's seat at the controls while another pull-starts the engine from behind the go-cart to prevent it from running away on its own if a malfunction occurs, such as the failure of a clutch, throttle control or torque converters. The problem is compounded when a single individual in a go-cart has to restart it when no one else is around and there is no huge object against which to buttress the front of it.

Pull-starting engines on small equipment has a set of problems related to basing one's self for horizontal or oblique pulling while also avoiding pulling or tipping the small equipment.

SUMMARY OF THE INVENTION

In light of these problems with rewind pull-starting of small engines, objects of patentable novelty and utility taught by this invention are to provide a pull-down engine starter which:

- allows go-cart drivers to pull-start rewind-starter engines from a driver's seat with one or both hands;
- facilitates use of rewind starter engines on select small equipment that now requires electric starters; and
- stabilizes personal positioning for pull-starting engines on a wide variety of small equipment and large tools easier and safer.

This invention accomplishes these and other objectives with a pull-down line that is attached to a pull-start line or directly to a rewind-starter wheel and then pulley-routed to a suspension pulley from which a handle end of the starter line is suspended to conveniently grasping proximity to a user position. For a go-cart or other rider-operated vehicle with a rewind starter, the user position is a driver's seat or a machine-operator position on the vehicle. For walk-behind machines and other non-ride machines with rewind-starter engines, the user position is generally lateral to the engine.

The above and other objects, features and advantages of the present invention should become even more readily apparent to those skilled in the art upon a reading of the following detailed description in conjunction with the drawings wherein there is shown and described illustrative embodiments of the invention.

BRIEF DESCRIPTION OF DRAWINGS

This invention is described by appended claims in relation to description of a preferred embodiment with reference to the following drawings which are explained briefly as follows:

DESCRIPTION OF PREFERRED EMBODIMENT

Figure 1:
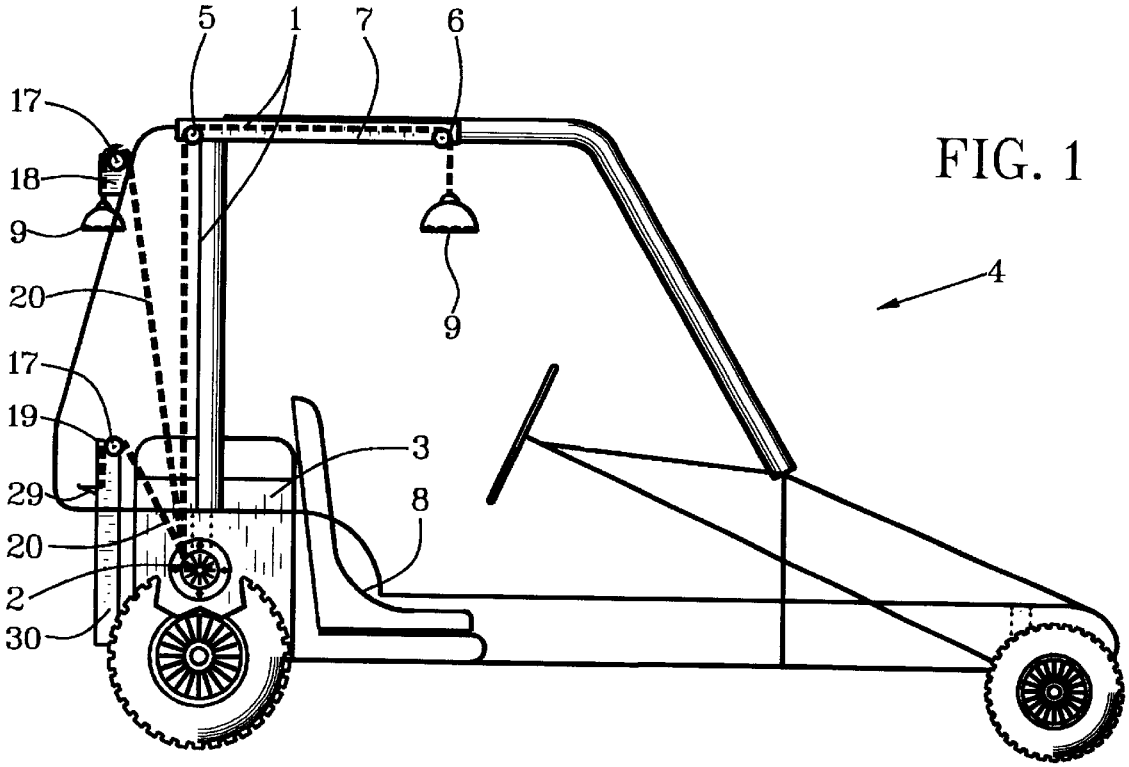
FIG. 1 is a partially cutaway side view of a pull-down engine starter on a go-cart having also optional supplementary pull-down starters that are foot-operative and hand operative.

Listed numerically below with reference to the drawings are terms used to describe features of this invention. These terms and list numbers assigned to them designate the same features throughout this description.

1. Pull-down line
2. Rewind starter
3. Pull-start engine
4. Go-cart
5. Directional pulley wheel
6. Suspension pulley wheel
7. Overhead bracket
8. Driver's seat
9. Two-hand handle
10. Supplemental pulley wheel
11. Support bracket
12. Hybrid go-cart
13. Utility machinery
14. Rewind-starter wheel
15. Take-off line
16. Line joiner
17. Supplementary singular wheel
18. Head-high anchor
19. Waist-high anchor
20. Supplementary singular line
21. Rewind-starter aperture
22. Singular-wheel pull-start line

23. Walk-behind gardening machine
24. Generator set
25. Singular-suspension pulley wheel
26. Head-high pull-down anchor
27. Waist-high pull-down anchor
28. Hand-grasp handle
29. Stirrup
30. Stirrup guide Referring first to FIG. 1, a pull-down line 1 is extended from a rewind-starter wheel of a rewind starter 2 of a pull-start engine 3 on an engine-use apparatus such as a go-cart 4 and routed in contact with a succession of pulley wheels or idler wheels including a directional pulley wheel 5 and a suspension pulley wheel 6. The directional pulley wheel 5 is mounted preferably to a direction mount such as an overhead bracket 7 on vehicle framework for routing the pull-down line 1 at least partly or as may be desired in a direction of the suspension pulley wheel 6. Also preferably on the overhead bracket 7, the suspension pulley wheel 6 is anchored proximately above a user position such as a driver's seat 8 from which a handle such as a two-hand handle 9 on a handle end of the pull-down line 1 can be grasped and pulled down conveniently while a driver is safely in control of the go-cart 4. The go-cart 4 is powered by the pull-start engine 3 which is positioned aft of the driver's seat 8.

Figure 2:
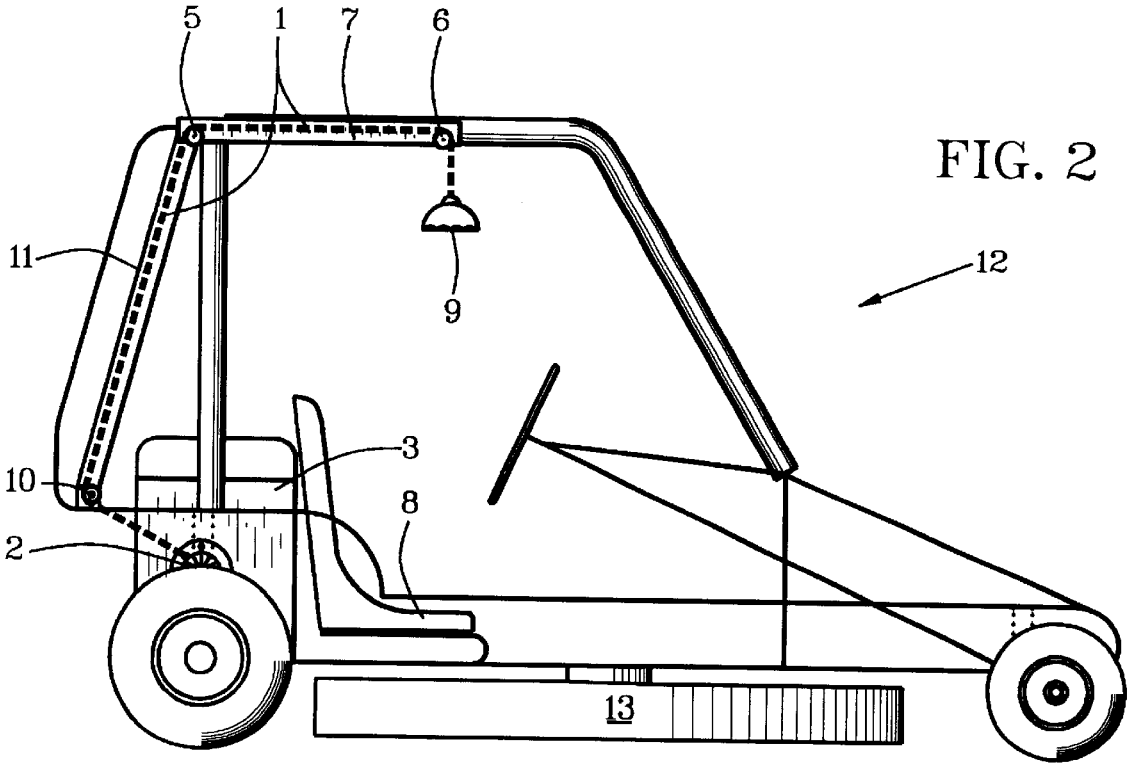
FIG. 2 is a side view of a pull-down engine starter having a supplemental or idler pulley wheel for positioning a pull-down line advantageously on a go-cart.

Referring to FIGS. 1–2, a supplemental pulley wheel 10 or idler wheel depicted in FIG. 2 upwardly and aft of the rewind starter 2 can be employed for positioning the pull-down line 1 away from predetermined vehicle space en route to the suspension pulley wheel 6 in addition to preventing frictional side-pull of the pull-down line 1 against walls of a line aperture in the rewind starter 2. A support bracket 11 can be employed in combination with the overhead bracket 7.

Figure 3:
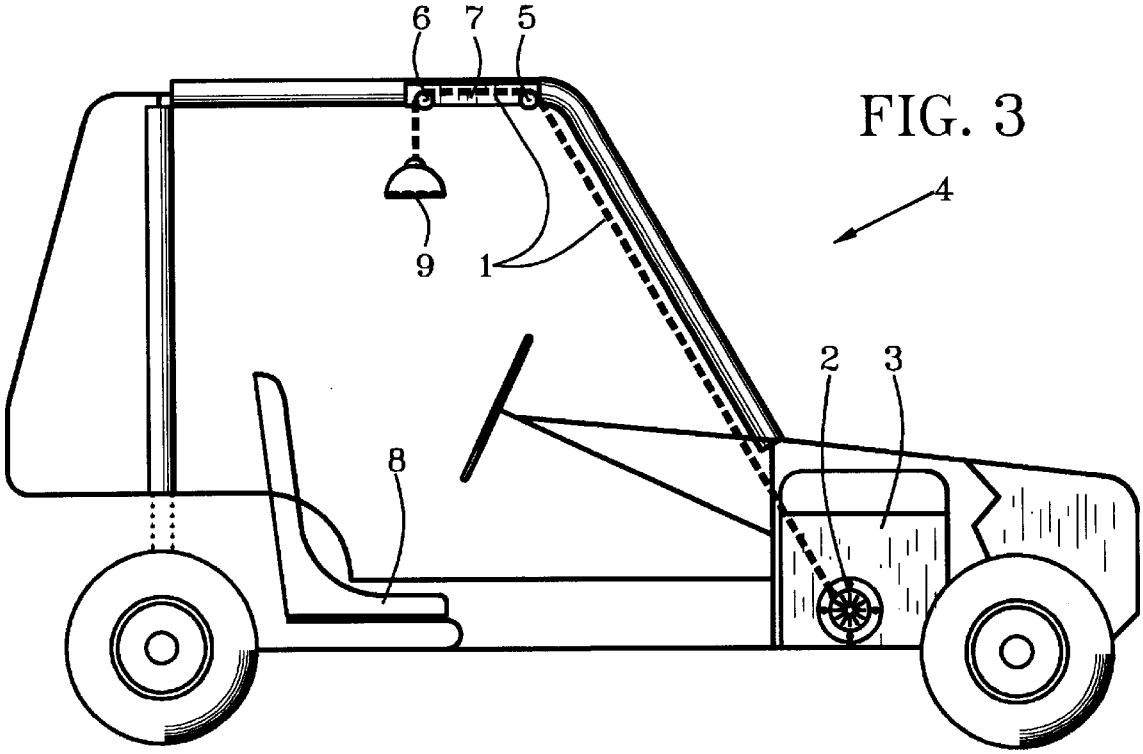
FIG. 3 is a partially cutaway side view of a pull-down starter on two-or-four-wheel-drive go-cart with a front-mounted engine to illustrate use on larger engines without requiring an electrical system for electrical starting.
Figure 4:
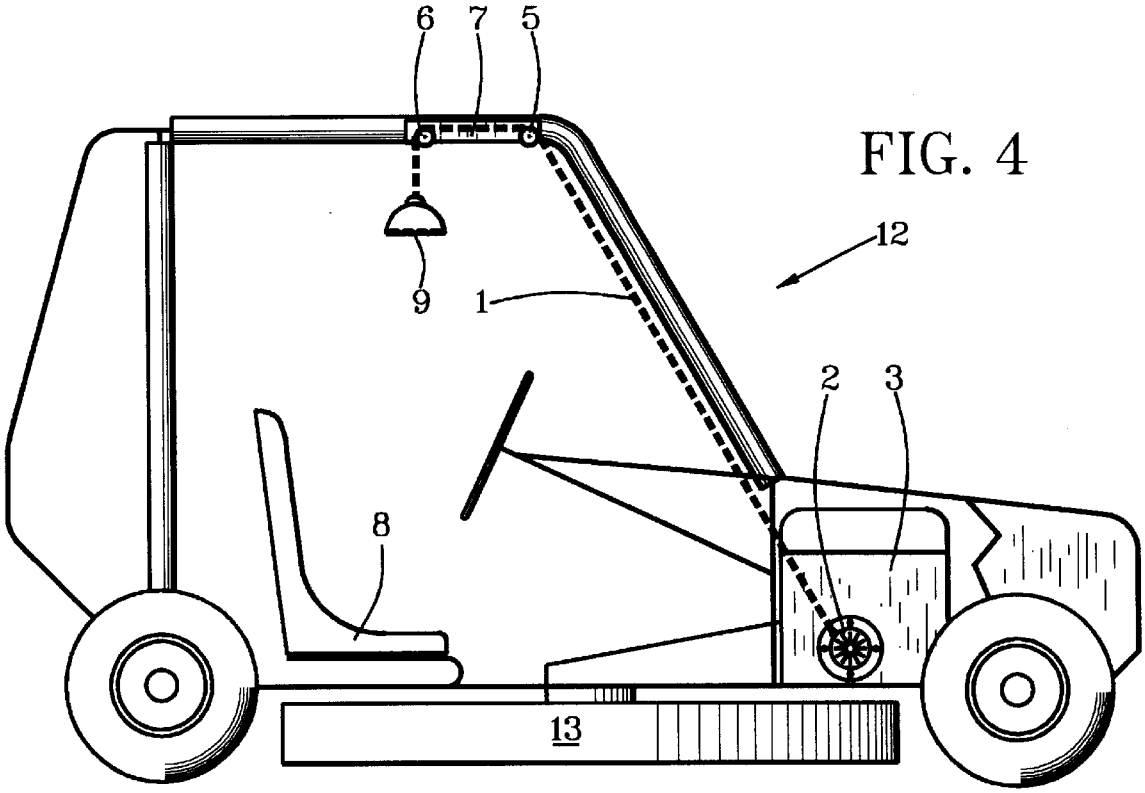
FIG. 4 is a partially cutaway side view of a pull-down starter on a front-engine vehicle intended primarily for gardening and other utility activities, but which can be used also for recreation.

Referring to FIGS. 1–4, the pull-start engine 3 can be positioned forward from the driver's seat 8 as depicted in FIG. 3 for a go-cart 4 with two-or-four-wheel drive and as depicted in FIG. 4 for a hybrid go-cart 12 that has optional utility machinery 13 with two-or-four-wheel drive. This pull-down engine starter allows use of smaller engines on larger vehicles without electrical systems and electrical starters. Weight and cost for four-wheel drive with a front or a rear engine is little if any more than for an electrical system and electrical starting. Lighting electricity for road and off-road uses can be provided with relatively little cost and weight. Starter electrics are the main cost and weight of a vehicle-electrical system for approximately go-cart sizes of recreational and/or utility vehicles.

Figures 5, 6, 7, 8, 9:
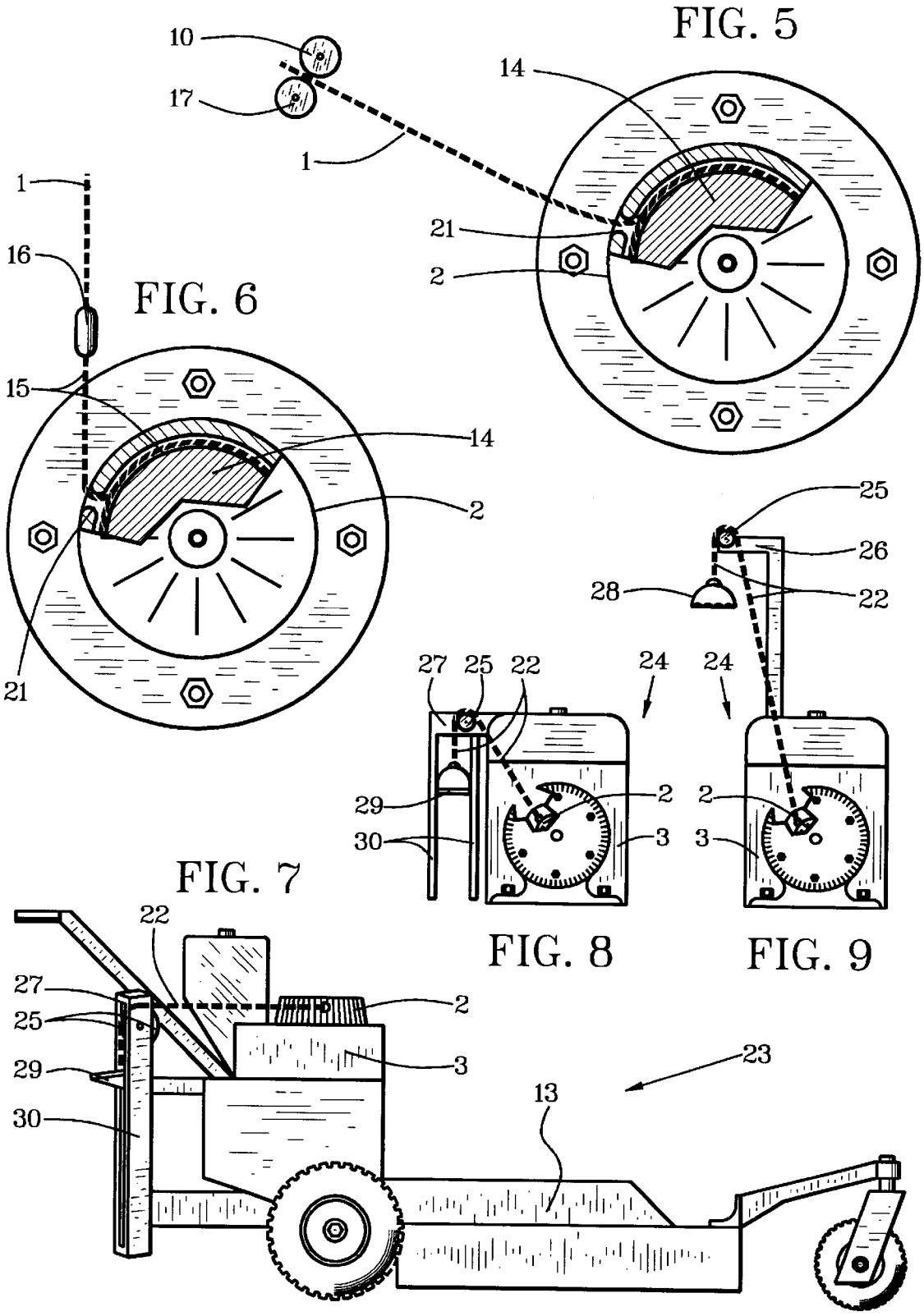
FIG. 5 is a partially cutaway side view of a rewind starter with a pull-down line attached directly to a rewind wheel and depicting supplemental or idler pulley wheels for directing the pull-down line either up to be routed down over a suspension pulley wheel or to be routed down directly from a singular-suspension pulley wheel.
FIG. 6 is a partially cutaway side view of a rewind starter with a pull-down line attached to a takeoff line that is attached to the rewind wheel.
FIG. 7 is a side view of a walk-behind gardening machine having a pull-down line routed directly over the singular-suspension pulley wheel for pull-down with a peddle-like foot stirrup having a stirrup guide.
FIG. 8 is a partially cutaway end view of a generator set with a pull-start engine having a pull-down line routed directly over a waist-height suspension pulley wheel for pull-down with a foot handle-like stirrup in a stirrup guide.
FIG. 9 is a partially cutaway end view of the generator set with a pull-start engine having a pull-down line routed directly over a head-height suspension pulley wheel for pull-down with a single-or-two-hand handle.

Referring to FIGS. 5–6, extension of the pull-down line 1 from a rewind-starter wheel 14 can be by attachment of the pull-down line 1 to a take-off line 15 that is attached to the rewind-starter wheel 14 as shown in FIG. 6. A line joiner 16 is preferred to a mere knot, but either can be used. As shown in FIG. 5, extension of the pull-down line 1 from the rewind-starter wheel 14 can be with attachment of the pull-down line 1 directly to the rewind-starter wheel 14 and providing sufficient length to reach the user position after being routed over at least the directional pulley wheel 5 and the suspension pulley wheel 6 described in relation to FIGS. 1–4.

Direct attachment of the pull-down line 1 to the rewind starter wheel 14 allows use of the supplemental pulley wheel 10 described in relation to FIG. 2 and a supplementary singular-suspension pulley wheel that is referred to briefly as a supplementary singular wheel 17 shown in FIG. 5 separately. The supplementary singular wheel 17 is shown in FIG. 1 in relation to a head-high anchor 18 and a waist-high anchor 19 for a supplementary singular-wheel pull-down line 1, referred to briefly as a supplementary singular line 20, that are optional and supplemental to the pull-down line 1.

The supplemental pulley wheel 10 and the supplementary singular wheel 17 direct the pull-start line 1 and the supplementary singular line 20 away from frictional contact with sides of a rewind-starter aperture 21 that are not provided with bearing-wheel surfaces.

Referring to FIGS. 7–9, a singular-wheel pull-start line 22 is extended from a rewind starter 2 of a pull-start engine 3 on an engine-use apparatus such as a walk-behind gardening machine 23 depicted in FIG. 7 and a generator set 24 depicted in FIGS. 8–9. The singular-wheel pull-start line 22 is routed in contact with a singular-suspension pulley wheel 25 from which a handle end of the singular-wheel pull-start line 22 is suspended downward proximate a user position. The user position is generally beside a machine powered by the pull-start engine 3, but can be either ground-based or vehicle-based.

The singular-suspension pulley wheel 25 is attached rotatably to a singular-wheel pull-down anchor such as a head-high pull-down anchor 26 shown in FIG. 9 or a waist-high pull-down anchor 27 shown in FIGS. 7–8. A handle end of the singular-wheel pull-start line 22 for a head-high pull-down anchor 26 has a hand-grasp handle 28. A handle end of the singular-wheel pull-start line 22 for a waist-high pull-down anchor 27 has a stirrup 29 that can be a foot-insertion type similar to a handle as shown in FIG. 8 or a foot-placement type as shown in FIG. 7. A predetermined stirrup guide 30 with one or more guide ways is preferable to prevent side-travel of the stirrup to aid body stability for the user when applying high body weight to the stirrup 29.

A new and useful pull-down engine starter having been described, all such foreseeable modifications, adaptations, substitutions of equivalents, mathematical possibilities of combinations of parts, pluralities of parts, applications and forms thereof as described by the following claims and not precluded by prior art are included in this invention.

What is claimed is:

1. A pull-down engine starter comprising:

a pull-down line extended from a rewind-starter wheel of a pull-start engine on an engine-use apparatus and routed in contact with a succession of pulley wheels to a user position;

the succession of pulley wheels including at least a directional pulley wheel and a suspension pulley wheel;

the directional pulley wheel being anchored to the engine-use apparatus for routing the pull-down line at least partly in a direction of the suspension pulley wheel;

the suspension pulley wheel being anchored proximately above the user position; and the pull-down line being positioned on the suspension pulley wheel and suspended downwardly with a handle end of the pull-down line being proximate the user position, wherein the engine-use apparatus is a vehicle motorized by the pull-start engine and the user position is a driver seat for driving the vehicle.

2. A pull-down engine starter as described in claim 1 and further comprising:

at least one supplemental pulley wheel over which the pull-down line is routed for positioning the pull-down line away from predetermined vehicle space on the vehicle en route to the suspension pulley wheel.

3. A pull-down engine starter as described in claim 3 wherein:

the pull-start engine is positioned aft of the driver seat;

the directional pulley wheel is oriented laterally to an axis of a rewind wheel of the rewinder;

the at least one supplemental pulley wheel is positioned upwardly from and aft of the rewind-starter wheel;

the directional pulley wheel, the at least one supplemental pulley wheel and the suspension pulley wheel being anchored to mounting members on the vehicle.

4. A pull-down engine starter as described in claim 1 wherein:

extension of the pull-down line from the rewind-starter wheel is by attachment of the pull-down line directly to the rewind-starter wheel and providing sufficient length of the pull-down line to reach the user position after being routed over at least the directional pulley wheel and the suspension pulley wheel.

5. A pull-down engine starter comprising:

a pull-down line extended from a rewind-starter wheel of a pull-start engine on an engine-use apparatus and routed in contact with a succession of pulley wheels to a user position;

the succession of pulley wheels including at least a directional pulley wheel and a suspension pulley wheel;

the directional pulley wheel being anchored to the engine-use apparatus for routing the pull-down line at least partly in a direction of the suspension pulley wheel;

the suspension pulley wheel being anchored proximately above the user position;

the pull-down line being positioned on the suspension pulley wheel and suspended downwardly with a handle end of the pull-down line being proximate the user position, wherein at least the suspension pulley wheel and one supplemental pulley wheel are attached to a support bracket that is attachable to framework of the engine-use apparatus; and the engine-use apparatus is a go-cart having overhead framework and the support bracket is attachable to the overhead framework.

* * * * *